United States Patent [19]

Shirai et al.

[11] 4,405,702

[45] Sep. 20, 1983

[54] ELECTROPHOTOGRAPHIC IMAGE-FORMING MEMBER WITH LADDER-TYPE SILICON RESIN LAYER

[75] Inventors: Shigeru Shirai, Yamato; Junichiro Kanbe; Shigeru Ohno, both of Yokohama, all of Japan

[73] Assignee: Canon Kabushiki Kaisha, Tokyo, Japan

[21] Appl. No.: 338,046

[22] Filed: Jan. 8, 1982

[30] Foreign Application Priority Data

Jan. 16, 1981 [JP] Japan ..... 56-5643

[51] Int. Cl.[3] ..... G03G 5/082

[52] U.S. Cl. ..... 430/60; 430/64; 430/84

[58] Field of Search ..... 430/64, 60, 61, 62, 430/84

[56] References Cited

U.S. PATENT DOCUMENTS 4,265,991 5/1981 Hirai et al. ..... 430/65

FOREIGN PATENT DOCUMENTS 56-89745 7/1981 Japan ..... 430/62

*Primary Examiner*—John E. Kittle
*Assistant Examiner*—John L. Goodrow
*Attorney, Agent, or Firm*—Fitzpatrick, Cella, Harper & Scinto

[57] ABSTRACT

An electrophotographic image-forming member comprises: an electrophotographic supporting substrate; a photoconductive layer constituted of an amorphous material which contains silicon atoms as matrix and at least one of hydrogen atoms and halogen atoms; and a resin layer formed by use of a ladder type of silicon resin, between said supporting substrate and photo-conductive layer.

26 Claims, 2 Drawing Figures

ELECTROPHOTOGRAPHIC IMAGE-FORMING MEMBER WITH LADDER-TYPE SILICON RESIN LAYER

BACKGROUND OF THE INVENTION

1. Field of the Invention

This invention relates to electrophotographic image-forming members sensitive to electromagnetic waves such as light (herein used in a wide sense, representing ultraviolet rays, visible light, infrared rays, X-rays, $\gamma$-rays, etc.) and used in the image-forming technique area.

2. Description of the Prior Art

Referring to photoconductive materials constructing photoconductive layers in electrophotographic image-forming members, there are well known Se, Se-Te CdS, ZnO, and organic photoconductive materials such as PVCz, TNF, and the like. Meanwhile, amorphous silicon (hereinafter, denoted by a-Si) has become of major interest lately as a photoconductive material promising in that, as described in, e.g. German Patent Offen Nos. 2746967 and 2855718. It has characteristics comparable to other photoconductive materials in photosensitivity, spectral wave length region, light-response, and dark resistance, and in addition, its p-n control is easy in spite of the amorphous form, and it is harmless to the human body.

Because of such character of a-Si superior to that of other photoconductive materials in many respect, its practical application to electrophotographic image-forming members has been rapidly pushed forward, but it is still leaving problems to be solved.

For example, image-forming members employing a-Si will cause objectionable phenomena, such as remainder of residual potential during use, fatigue accumulation during long-term repeated operations, and ensuing ghost phenomenon and whitening in transfer images.

Moreover, when the thickness of a-Si layer exceeds more than ten microns, the layer becomes, with the lapse of time of standing in the air after removal from a vacuum deposition, liable to cause such phenomena as peeling or separating from the supporting substrate and crack development therein. These phenomena tend to occur frequently in particular when its supporting substrate is of a drum shape, which is usually employed in the field of electrophotography. Thus, there are problems to be solved in aging stability.

In view of the above, this invention has been accomplished after studying the results of many intensive studies on the following matters: that is, the present inventors formed photoconductive layers from amorphous materials comprising silicon as matrix and at least either one of hydrogen atoms (H) and halogen atoms (X) [hereinafter, these amorphous materials denoted by a-Si (H, X)] and investigated the characteristics of said layers and the relation between said layers and the substrates supporting them, from the standpoints of mechanical, electrical, and photoconductive properties and of durability.

According to studies by the present inventors, a-Si (H, X) seems to have a large strain when forming a layer, therefore the layer may peel off or separate from the supporting substrate or crack in itself. It is hence necessary to obtain the following objectives: to remove the strain of the formed layer or relax it to such an extent that it has no adverse effect, by some means; to optimize the mechanical and electrical contact between the substrate and the a-Si (H, X) layer; to improve the adhesion between them; and to establish such optimum conditions as to satisfy at the same time the above-mentioned needs, in order to obtain an electrophotographic image-forming member excellent in electrophotographic characteristics, particularly in durability. Thereafter, as a result of a great deal of studies and investigations, they were successful in establishment of the optimum conditions.

SUMMARY OF THE INVENTION

An object of this invention is to provide an electrophotographic image-forming member that can be used repeatedly for a long period without developing any substantial residual potential, accumulating fatigue, producing ghosts, and whitening in transfer images.

Another object of the invention is to provide an electrophotographic image-forming member that keeps intimate adhesion between its supporting substrate and photoconductive layer and can maintain its initial characteristics and invariably and stably give high-quality images, during long-term continuous repeated operations, and being excellent in aging stability.

A further object of the invention is to provide an electrophotographic image-forming member which comprises: an electrophotographic supporting substrate; a photoconductive layer constituted of an amorphous material [a-Si (H, X)] which contains silicon as matrix and at least one of hydrogen atoms and halogen atoms and if necessary, germanium; and a resin layer formed by use of a ladder type of silicon resin, between said supporting substrate and photoconductive layer.

According to the present invention, there is provided an electrophotographic image-forming member which comprises: an electrophotographic supporting substrate; a photoconductive layer constituted of an amorphous material which contains silicon atoms as matrix and at least one of hydrogen atoms and halogen atoms; and a resin layer formed by use of a ladder type of silicon resin, between said supporting substrate and photoconductive layer.

DESCRIPTION OF THE PREFERRED EMBODIMENTS

Figure 1:
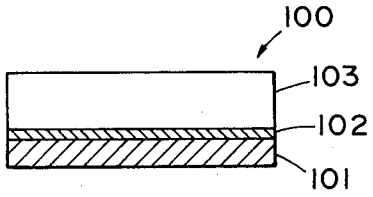
FIG. 1 is a schematic sectional view illustrating the layer construction of a typical example of the electrophotographic image-forming member of this invention.

Referring now to the drawings, this invention is described in detail.

FIG. 1 shows a schematic sectional view illustrating the layer construction of the most basic example of the electrophotographic image-forming member of this invention.

The electrophotographic image-forming member 100, shown in FIG. 1, comprises a supporting substrate 101, a resin layer 102, formed from a ladder type of silicon resin having the chemical structure mentioned later, on the supporting substrate 101, treated for use in electrophotography, and a photoconductive layer 103 constituted of an amorphous material a-Si (H, X) which contains silicon as matrix and at least one of hydrogen atoms (H) and halogen atoms (X).

The electrophotographic image-forming member of this invention, having such construction, is advantageous in that; it develops no appreciable residual potential or if any, in a negligible degree; it is excellent in mechanical and electrical contact and inter-layer adhesion so that the photoconductive layer does not peel off and separate from the substrate or crack; and it gives toner transfer images of high quality and of high resolution without appreciable degradation of the initial characteristics even after repeated cycling in long-term continuous operation.

The supporting substrate 101 may be either conductive or insulating, electrically. The applicable conductive substrates include metals and alloys of, for example, NiCr, stainless steel, Al, Cr, Mo, Au, Nb, Ta, V, Ti, Pt, Pd, and the like.

The typical insulating substrates usually employed include films or sheets of synthetic resins such as polyesters, polyethylene, polycarbonates, cellulose acetate, polypropylene, poly(vinyl chloride), poly(vinylidene chloride), polystyrene, polyamides, and the like, glass, ceramics, paper, and the like. These insulating substrates preferably have at least one conductivized surface, on which other layers are laid.

For example, conductivity is imparted by coating the substrate surface with a thin film comprising NiCr, Al, Cr, Mo, Au, Ir, Nb, Ta, V, Ti, Pt, Pd, $In_2O_3$, $SnO_2$, ITO($In_2O_3+SnO_2$), or the like, when the substrate is glass, and with a thin film of metal such as NiCr, Al, Ag, Pb, Zn, Au, Cr, Mo, Ir, Nb, Ta, V, Ti, Pt, or the like by vacuum deposition, electron beam deposition, sputtering, or foil lamination when the substrate is a film of synthetic resin such as polyesters film and the like.

The shape of the supporting substrate may be cylindrical, belt-form, or plate-form, being chosen as desired; for example, in the case of high-speed continuous copying, an endless belt-form or cylindrical substrate is properly decided so as to form an electrophotographic image-forming member as desired. When a flexible electrophotographic image-forming member is requested, the thickness of the substrate is reduced as far as possible so that the substrate may fully exhibit functions thereof. However, a thickness of 10μ or more is usually adopted in view of the preparation, handling, and mechanical strength of the substrate.

The resin layer 102 is made up of a ladder type of silicon resin having a chemical structure represented by the following formula (1):

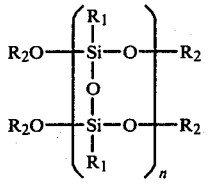

(1)

(wherein $R_1$ and $R_2$ each represent a substituent selected from hydrogen (H), methyl ($CH_3$), ethyl ($C_2H_5$), and phenyl ($C_6H_5$).)

It should be noted that $R_1$ and $R_2$ need not be the same in the molecules of the formula (1). That is to say, the whole $R_1$ and $R_2$ in the molecules may be, for example, a combination of methyl and phenyl at a molar ratio of methyl: phenyl=2:1 or a combination of hydrogen and ethyl at a molar ratio of hydrogen: ethyl=1:1. It is also permitted that $R_1$ is, for example, methyl and $R_2$, for example, ethyl or phenyl.

The ladder type of silicon resin represented by formula (1) has a by far higher heat resistance (thermal decomposition-starting temperature is about 540° C. for a relatively low heat resistant one) as compared with other resins, so that, when a photoconductive layer 103 comprising a-Si (H, X) is directly formed on the resin layer 102 of said silicon resin, a high temperature of the supporting substrate can be adopted, thereby permitting to increase the rate of layer formation and to deposit a-Si (H, X) of excellent photoconductive characteristics on the resin layer 102.

The resin represented by formula (1) exhibits, if its thermal decomposition occurs, a weight retention of very as high as 99–95%, thus remaining for the most part of a resin layer without decomposition. Accordingly, decomposition of the resin has almost no influence during the formation of the photoconductive layer 103 on the resin layer 102.

The resin layer 102 of the electrophotographic image-forming member of this invention is formed in the following way: a resin represented by formula (1) is dissolved in an organic solvent such as n-butyl cellosolve acetate and the like to a desired concentration, the resulting solution is coated by use of a spinner or the like on a supporting substrate 101 for electrophotography, and the coating is cured under desired conditions of atmosphere, temperature, and time.

Since the ladder type of silicon resin represented by formula (1) shows a very low viscosity even when the concentration of its solution is considerably high (for example, about 18 cp at 20 wt.% concentration), it is possible to form a layer of fine and uniform thickness of the resin over a wide surface area, and to achieve easily controlling and uniforming electrical characteristics between the supporting substrate 101 and the photoconductive layer 103.

Since the resin represented by formula (1) contains silicon and oxygen atoms in the molecule, it is assumed that an interface excellent in electrical and mechanical affinity can be formed between the resin layer 102 and the photoconductive layer 103 on the resin layer. Therefore, it is possible to prepare easily an electrophotographic image-forming member excellent in photoconductive characteristics for electrophotography.

Furthermore, since the resin represented by formula (1) possesses a high insulating electric resistance, it can function as an electric barrier between the supporting substrate 101 and the photoconductive layer 103.

While the resin layer 102 in this invention is formed by use of a ladder type of silicon resin represented by formula (1), it can be also formed by use of prepolymer of a mixture of a resin of formula (1) with a required amount of a polydiethoxysilane represented by the following formula (2):

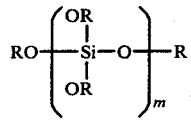

(2)

wherein R is $C_2H_5$ or H, and $C_2H_5$/H=1/1.

The amount of a polydiethoxysilane represented by formula (2) to be added is properly chosen so as to give requested heat resisting characteristics of the resin layer since they vary depending upon said amount added. Usually, up to 60%, preferably up to 45%, by weight of said polydiethoxysilane is added based on the weight of a resin represented by formula (1).

The thickness of the resin layer 102 is properly chosen depending upon the allowable limit for uniformity of the layer thickness and formation of the layer, and upon the characteristics imposed on the resin layer. Said thickness, however, is usually 0.1–5μ, preferably 0.1–2μ, in order to achieve sufficiently the objects of this invention.

The photoconductive layer 103 laminated on the resin layer 102 is constituted of a-Si (H, X) having one of the following semiconductor characteristics, in order to attain the objects of this invention effectively:

(1) p-Type of a-Si (H, X): containing an acceptor alone or both a donor and an acceptor in the relative concentration of the latter being high.

(2) $p^-$-Type of a-Si (H, X): the same as type (1) but the concentration of acceptor (Na) is relatively low.

(3) n-Type of a-Si (H, X): containing a donor alone or both a donor and an acceptor in the relative concentration of the former being high.

(4) $n^-$-Type of a-Si (H, X): the same as type (3) but the concentration of donor (Nd) is relatively low.

(5) i-Type of a-Si (H, X): wherein $Na \simeq Nd \simeq O$ or $Na \simeq Nd$.

The halogen atoms (X) contained in the photoconductive layer 103, in this invention, include, for example, fluorine, chlorine, bromine, and iodine, of which fluorine and chlorine are more favorable.

The photoconductive layer 103 constituted of a-Si (H, X) is formed, in this invention, by the vacuum deposition method which utilizes the electric discharge phenomenon such as, for example, glow discharge, sputtering, ion-plating, and the like. For instance, formation of a layer constituted of a-Si (H, X) by the glow discharge method is well performed by feeding a starting gas for supplying Si capable of supplying Si along with another starting gas for incorporating hydrogen atoms and/or a starting gas for incorporating halogen atoms into a deposition chamber which can be evacuated, and generating a glow discharge therein to form a layer of a-Si (H, X) on a prescribed supporting substrate previously set in a definite position. When the sputtering method is applied, a target made of Si may be sputtered in the atmosphere of an inert gas such as, for example, Ar, He, or the like or of a mixed gas based thereupon, while feeding hydrogen atoms and/or halogen atoms incorporating gaseous sources into a deposition chamber for sputtering purposes.

The gaseous Si sources effectively usable in this invention include gaseous or gasifiable silanes such as $SiH_4$, $Si_2H_6$, $Si_3H_8$, $Si_4H_{10}$, and the like, of which $SiH_4$ and $Si_2H_6$ are preferred in respect to advantages such as ease of handling in the operation of depositing the layer and higher efficiency of Si supply.

The halogen atoms incorporating sources effectively usable in this invention include many gaseous or gasifiable halogen compounds such as, for instance, halogen gases, halogenated compounds, inter-halogen compounds, and silane derivatives substituted by halogen. In addition, gaseous or gasifiable silicon compounds of which constituents are silicon and halogen atoms, in other words, gaseous or gasifiable halogen-containing silicon compounds can also exemplified as effective ones in this invention.

As individual examples of the halogen compounds suited for use in this invention, there may be cited gaseous halogens, i.e., fluorine, chlorine, bromine, and iodine; and inter-halogen compounds such as BrF, ClF, $ClF_3$, $BrF_5$, $BrF_3$, $IF_7$, $IF_5$, ICl, IBr, and the like.

As individual examples of the suited halogen-containing silane derivatives, namely, silane derivatives substituted by halogen there may be cited silicon halides such as $SiF_4$, $Si_2H_6$, $SiCl_4$, $SiBr_4$, and the like.

When employing such halogen-containing silicon compound electrophotographic image-forming members characteristic of this invention are prepared by the glow discharge method, a photoconductive layer comprising a-Si containing halogen atoms (X) can also be formed on the resin layer 102 laid on a given supporting substrate, without using a silane gas as the gaseous Si source.

In the basic process of forming the photoconductive layer 103 containing halogen atoms (X) by the glow discharge method, a silicon halide gas as a Si source for supplying Si and a gas such as Ar, $H_2$, He, or the like are introduced into a deposition chamber at a prescribed mixing ratio and flow rate, and a plasmic atmosphere of these gases is formed by generating a glow discharge, thereby forming the photoconductive layer 103 on the resin layer 102 laid on a prescribed supporting substrate. However, a hydrogen-containing gaseous silicon compound may also be admixed with these gases in a prescribed amount in order to incorporate hydrogen into the photoconductive layer 103.

Each group of gases may be used alone or in combination with one another in a prescribed mixing ratio. The formation of the photoconductive layer of a-Si (H, X) by the reaction sputtering method or the ion-plating method can be performed as follows: according to the sputtering method, a-Si target is sputtered in a prescribed atmosphere of gas plasma; according to the ion-plating method, silicon polycrystals or single crystals are placed as a vapor source in an evaporator boat and heated and evaporated by means of a resistance heater or by the electron beam method (EB method), and the emitted vapor particles are passed through said plasmic atmosphere.

In this case, for incorporation of halogen atoms into the photoconductive layer formed by either method of sputtering and ion-plating, the above-mentioned halogen compound or halogen-containing compound may be introduced into the deposition chamber and a plasmic atmosphere of said gaseous compound may be formed.

For incorporation of hydrogen atoms into the photoconductive layer, a gaseous source for incorporation of hydrogen atoms, for example, $H_2$ or the above-mentioned silane gas, may be introduced into a deposition chamber for sputtering purposes and a plasmic atmosphere of said gas may be formed.

Besides the above-mentioned halogen compounds or halogen-containing silicon compounds which are usable as effective halogen-incorporating gaseous source in this invention, hydrogen-containing gaseous or gasifiable halogenated compounds including hydrogen halide such as HF, HCl, HBr, and HI and halogen-substituted silanes such as $SiH_2F_2$, $SiH_2Cl_2$, $SiHCl_3$, $SiH_2Br_2$, $SiHBr_3$, and the like can be used as an effective starting material for forming the photoconductive layer.

In addition, structural incorporation of hydrogen atoms into the photoconductive layer can be also performed by generation of a glow discharge in the deposition chamber in the presence of $H_2$ or a gaseous silane such as $SiH_4$, $Si_2H_6$, $Si_3H_8$, $Si_4H_{10}$, and the like, together with a silicon compound for supplying Si.

For example, in the reaction sputtering method, a Si target is used, a gas for incorporating halogen atoms and $H_2$ gas with, if necessary, an inert gas, such as He or Ar are introduced into the deposition chamber, a plasmic atmosphere of said gases is produced, and said Si target is sputtered, whereby a photoconductive layer 103 of a-Si (H, X) is formed on the resin layer 102 of prescribed characteristics.

Moreover, a gas such as $B_2H_6$, $PH_3$, $PF_3$, and the like can be introduced for the purpose of both hydrogen incorporation and impurity addition.

In this invention, the desirable amount of H, X, or (H+X) contained in the photoconductive layer formed is usually 1–40 atomic %, preferably 5–30 atomic %.

The formation of a photoconductive layer of n-type, p-type, or i-type is accomplished by doping the photoconductive layer with a n-type of impurity, a p-type of impurity, or both of them while controlling the amount of the impurity, during the layer formation by the glow discharge method, the reaction sputtering method, or the like.

The impurities suited for doping the photoconductive layer include; elements in the group III-A of the periodic table, such as, for example, B, Al, Ga, In, Tl, and the like, as a p-type of impurity; and elements in the group V-A of the periodic table, such as, for example, N, P, As, Sb, Bi, and the like, as a n-type of impurity.

The amount of impurity doping the photoconductive layer is properly decided according to desired electrical and optical characteristics of the layer. In general, for $n^-$-type, i-type or $p^-$-type, the photoconductive layer may be dopted with up to $5\times10^{-3}$ atomic % of an impurity of the group III-A; for p-type, with $5\times10^{-3}$–$1\times10^{-2}$ atomic % of an impurity of the group III-A; and for n-type, with up to $5\times10^{-3}$ atomic % of an impurity of the group V-A.

The thickness of the photoconductive layer is properly decided so that photocarriers are efficiently generated in the photoconductive layer and the generated photocarriers are efficiently transported in a desired direction. The thickness is usually 3–100$\mu$, preferably 5–50$\mu$.

The electrophotographic image-forming member 100 shown in FIG. 1 has a layer construction built up by laminating the resin layer 102 and the photoconductive layer 103 in that order on the supporting substrate 101, wherein a barrier layer may also be provided between the substrate 101 and the resin layer 102 or between the resin layer 102 and the photoconductive layer 103 in order the further enhance the effect of barring the injection of electric charges from the substrate 101 side to the photoconductive layer 103 side during the charging treatment. Said barrier has functions to inhibit effectively the inflow of free carriers into the photoconductive layer 103 side from the substrate 101 side and facilitate the passage from the photoconductive layer 103 side to the substrate 101 side of the photocarriers which have been generated in the photoconductive layer by irradiation of electromagnetic wave during the exposing treatment.

This barrier layer is constituted of an amorphous material or an electric insulating metal oxide, the former comprising, for example, a silicon matrix and at least one member selected from carbon, nitrogen, and oxygen atoms and if necessary, at least one of hydrogen and halogen atoms (X). Said amorphous material is generically denoted by a-$[Si_x(C, N, O)_{1-x}]_y(H, X)_{1-y}$, wherein $0<x<1$ and $0<y<1$.

The halogen atoms (X) suitable for the constituent of the amorphous material are F, Cl, Br, and I, of which F and Cl are preferable.

The amorphous materials suitable for forming said barrier layer include, as carbon-containing amorphous materials, for example, a-$Si_aC_{1-a}$, a-$(Si_bC_{1-b})_cH_{1-c}$, a-$(Si_dC_{1-d})_eX_{1-e}$, and a-$(Si_fC_{1-f})_g(H+X)_{1-g}$; as nitrogen-containing amorphous materials, for example, a-$Si_hN_{1-h}$, a-$(Si_iN_{1-i})_jH_{1-j}$, a-$(Si_kN_{1-k})_lX_{1-l}$, and a-$(Si_mN_{1-m})_n(H+X)_{1-n}$; and as oxygen-containing amorphous material, for example, a-$Si_oO_{1-o}$, a-$(Si_pO_{1-p})_qH_{1-q}$, a-$(Si_rO_{1-r})_sX_{1-s}$, a-$(Si_tO_{1-t})_u(H+X)_{1-u}$, and the like; and further amorphous materials, as defined above, which contain at least two atoms of C, N, and O as constituent atoms, wherein 0<a through u<1.

The barrier layer of said amorphous material can be formed by methods such as the glow discharge, sputtering, ion implantation, ion-plating, electron beam, and the like methods.

For instance, according to the glow discharge method, the barrier layer can be formed by mixing, as required, a starting gas for forming said amorphous material with a diluent gas in a prescribed ratio, feeding the gas into a vacuum deposition chamber, forming plasma from the fed gas by generation of a glow discharge, to deposit said amorphous material on the above-said supporting substrate.

The starting gaseous materials suited for forming the barrier layer constituted of said carbon-containing amorphous material include gaseous silicon hydrides, which are constituted of Si and H, e.g., silanes such as $SiH_4$, $Si_2H_6$, $Si_3H_8$, and $Si_4H_{10}$; and hydrocarbons, which are constituted of C and H, e.g. $C_1$–$C_5$ saturated hydrocarbons, $C_2$–$C_5$ ethylene series hydrocarbons, and $C_2$–$C_4$ acetylene series hydrocarbons.

As individual examples of the starting gaseous hydrocarbons, there are cited methane ($CH_4$), ethane ($C_2H_6$), propane ($C_3H_8$), n-butane (n-$C_4H_{10}$), and pentane ($C_5H_{12}$) as saturated hydrocarbons; ethylene ($C_2H_4$), propylene ($C_3H_6$), butene-1 ($C_4H_8$), butene-2 ($C_4H_8$), isobutylene ($C_4H_8$), and pentene ($C_5H_{10}$) as ethylene series hydrocarbons; and acetylene ($C_2H_2$), methylacetylene ($C_3H_4$), and butyne ($C_4H_6$) as acetylene series hydrocarbons.

In addition, gaseous materials constituted of Si, C, and H can also be used as the starting material to form the barrier layer, which include alkyl silane such as $Si(CH_3)_4$ and $Si(C_2H_5)_4$.

Hydrogen gas ($H_2$) can be, of course, used as an effective starting material for incorporating H into the barrier layer.

The starting gaseous materials for incorporating halogen atoms into the barrier layer include halogen elements, hydrogen halides, inter-halogen compounds, silicon halides, and halogen-substituted silanes.

Individual examples thereof are fluorine, chlorine, bromine, and iodine as halogen elements; HF, HCl, HBr, and HI as hydrogen halides; BrF, ClF, $ClF_3$, $ClF_5$, $BrF_5$, $BrF_3$, $IF_7$, $IF_5$, ICl, and IBr as inter-halogen compounds; $SiF_4$, $Si_2H_6$, $SiCl_4$, $SiCl_3Br$, $SiCl_2Br_2$, $SiClBr_3$, $SiCl_3I$, and $SiBr_4$ as silicon halides; and $SiH_2F_2$, $SiH_2Cl_2$, $SiHCl_3$, $SiH_3Cl$, $SiH_3Br$, $SiH_2Br_2$, and $SiHBr_3$ as halogen-substituted silanes.

Besides these, the following compounds also can be used as the starting gaseous materials for incorporating halogen into the barrier layer: halogen-substituted paraffin hydrocarbons such as $CCl_4$, $CHF_3$, $CH_2F_2$, $CH_3F$, $CH_3Cl$, $CH_3Br$, $CH_3I$, $C_2H_5Cl$, and the like; fluorinated sulfur compounds such as $SF_4$ and $SF_6$; and halogen-containing alkyl silanes such as $SiCl(CH_3)_3$, $SiCl_2(CH_3)_2$, and $SiCl_3CH_3$.

The formation of the barrier layer constituted of a nitrogen-containing amorphous material according to the glow discharge method can be performed by use of a suitable compound selected from the above-cited starting materials for forming the barrier layer and one of the following N-incorporating gaseous materials: That is, the starting materials for incorporation of nitrogen atoms upon forming a N-containing barrier layer include gaseous or gasifiable nitrogen compounds such as nitrogen gas, nitrides, and azides, which are constituted of nitrogen atom or nitrogen and hydrogen atoms; individual examples thereof are nitrogen ($N_2$), ammonia ($NH_3$), hydrazine ($H_2NNH_2$), hydrogen azide ($HN_3$), ammonium azide ($NH_4N_3$), etc. Besides these, halogenated nitrogen compounds such as nitrogen trifluoride ($F_3N$), nitrogen tetrafluoride ($F_4N_2$), and the like can be used for incorporating nitrogen atoms simultaneously with halogen atoms.

When a barrier layer of an oxygen-containing amorphous material is formed by the glow discharge method, an oxygen-incorporating starting material is used along with a compound selected as desired from the above-cited starting materials of barrier layer formation. Such starting materials used for the incorporation of oxygen are gaseous or gasifiable compounds at least containing oxygen as constituent atoms.

The individual examples thereof are oxygen ($O_2$), ozone ($O_3$), carbon monoxide (CO), carbon dioxide ($CO_2$), nitrogen monoxide (NO), nitrogen dioxide ($NO_2$), dinitrogen oxide ($N_2O$), nitrogen sesquioxide ($N_2O_3$), dinitrogen tetraoxide ($N_2O_4$), dinitrogen pentaoxide ($N_2O_5$), and nitrogen trioxide ($NO_3$). Further, lower siloxanes, which contain Si, O, and H as constituent atoms such as for example, disiloxane ($H_3SiOSiH_3$) and trisiloxane ($H_3SiOSiH_2OSiH_3$) can be used for the incorporation of oxygen.

The formation of a barrier layer of a carbon-containing amorphous material according to the sputtering method can be performed by using a single crystalline or polycrystalline Si wafer, a C wafer, or a wafer containing Si and C in a mixed form, as a target, which is sputtered in an atmosphere of various kinds of gases.

In this case, in order to incorporate carbon atoms, hydrogen atoms, or halogen atoms into the barrier layer, the above-cited starting gaseous materials for the glow discharge method can also be used in the sputtering method as an effective starting material.

The formation of a barrier layer of a nitrogen-containing amorphous material according to the sputtering method can be performed by using a single crystalline or polycrystalline Si wafer, a $Si_3N_4$ wafer, or a wafer containing Si and $Si_3N_4$ in a mixed form, as a target, which is sputtered in atmospheres of various kinds of gases.

For example, when a Si wafer is used as the target, gaseous starting materials for incorporating nitrogen atoms and, if necessary, for incorporating hydrogen atoms and/or halogen atoms, e.g. $H_2+N_2$ or $NH_3$, if necessary, after diluted with a diluent gas, may be fed into a deposition chamber for sputtering purposes and the above-said wafer may be sputtered in a plasmic atmosphere of the fed gas.

The formation of a barrier layer of an oxygen-containing amorphous material according to the sputtering method can be performed by using a single crystalline or polycrystalline Si wafer, a $SiO_2$ wafer, or a wafer containing Si and $SiO_2$ in a mixed form, as a target, which is sputtered in atmospheres of various kinds gases for the incorporation of hydrogen atoms, halogen atoms, or oxygen atoms.

The contents of carbon atoms, nitrogen atoms, oxygen atoms, hydrogen atoms, and halogen atoms in the barrier layer of the above-said amorphous material, are important factors for obtaining the characteristics intended by the incorporation of these atoms.

When the barrier layer is constituted of a-$Si_aC_{1-a}$, the carbon content is usually 60–90 atomic %, preferably 65–80 atomic %, most preferably 70–75 atomic %, or in terms of a, a is usually 0.1–0.4, more preferably 0.2–0.35, most preferably 0.25–0.3. When constituted of a-$(Si_bC_{1-b})_cH_{1-c}$, the carbon content is usually 30–90 atomic %, preferably 40–90 atomic %, most preferably 50–80 atomic %, and the hydrogen content is usually 1–40 atomic %, preferably 2–35 atomic %, most preferably 5–30 atomic %, or in terms of b and c, b is usually 0.1–0.5, preferably 0.1–0.35, most preferably 0.15–0.3, and c is usually 0.60–0.99, preferably 0.65–0.98, most preferably 0.7–0.95. When constituted of a-$(Si_dC_{1-d})_eX_{1-e}$ or a-$(Si_fC_{1-f})_g$-$(H+X)_{1-g}$, the carbon content is usually 40–90 atomic %, preferably 50–90 atomic %, most preferably 60–80 atomic %, and the halogen content or the total content of halogen and hydrogen is usually 1–20 atomic %, more preferably 1–18 atomic %, most preferably 2–15 atomic %; and the hydrogen content where both halogen and hydrogen are contained is usually up to 19 atomic %, more preferably up to 13 atomic %; or in terms of d, e, f, and g, d and f each are usually 0.1–0.47, more preferably 0.1–0.35, most preferably 0.15–0.3; and e and g each are usually 0.8–0.99, more preferably 0.85–0.99, most preferably 0.85–0.98.

When the barrier layer is constituted of a nitrogen-containing amorphous material a-$Si_hN_{1-h}$, the nitrogen content is usually 43–60 atomic %, more preferably 43–50 atomic %; or in terms of h, h is usually 0.43–0.60, more preferably 0.43–0.50.

When constituted of a-$(Si_iN_{1-i})_jH_{1-j}$, the nitrogen content is usually 25–55 atomic %, more preferably 35–55 atomic %; and the hydrogen content is usually 2–35 atomic %, more preferably 5–30 atomic %; or in terms of i and j, i is usually 0.43–0.6, more preferably 0.43–0.5; and j is usually 0.65–0.98, more preferably 0.7–0.95.

When constituted of a-$(Si_kN_{1-k})_lX_{1-l}$, or a-$(Si_mN_{1-m})_n(H+X)_{1-n}$, the nitrogen content is usually 30–60 atomic %, more preferably 40–60 atomic %; the halogen content or the total content of halogen and hydrogen is usually 1–20 atomic %, more preferably 2–15 atomic %; the hydrogen content where both halogen and hydrogen are contained is usually up to 19 atomic %, more preferably up to 13 atomic %; or in terms of k, l, m, and n, k and m each are usually 0.43–0.60, more preferably 0.43–0.49; and l and n each are usually 0.8–0.99, more preferably 0.85–0.98.

When the barrier layer is constituted of an oxygen-containing amorphous material a-$Si_oO_{1-o}$, the oxygen content is usually 60–67 atomic %, more preferably 63–67 atomic %; or in terms of o, o is usually 0.33–0.40, more preferably 0.33–0.37.

When constituted of a-$(Si_pO_{1-p})_qH_{1-q}$, the oxygen content is usually 39–66 atomic %, more preferably 42–64 atomic %; the hydrogen content is usually 2–35 atomic %, more preferably 5–30 atomic %; or in terms of p and q, p is usually 0.33–0.4, more preferably 0.33–0.37; and q is usually 0.65–0.98, more preferably 0.7–0.95.

When constituted of a-$(Si_rO_{1-r})_sX_{1-s}$ or a-$(Si_tO_{1-t})_u(H+X)_{1-u}$, the oxygen content is usually 48–66 atomic %, more preferably 51–66 atomic %; the halogen content or the total content of halogen and hydrogen is usually 1–20 atomic %, more preferably 2–15 atomic %; the hydrogen content where both halogen and hydrogen are contained is usually up to 19 atomic %, more preferably up to 13 atomic %; or in terms of r, s, t, and u, r and t each are usually 0.33–0.40, more preferably 0.33–0.37; and s and u each are usually 0.8–0.99, more preferably 0.85–0.98.

The preferred electric insulating metallic oxides that the barrier layer is constituted of $TiO_2$, $Ce_2O_3$, $ZrO_2$, $HfO_2$, $GeO_2$, CaO, BeO, $P_2O_5$, $Y_2O_3$, $Cr_2O_3$, $Al_2O_3$, MgO, $MgO.Al_2O_3$, $SiO_2.MgO$, and the like. Combined use of two or more these oxides is also possible to form the barrier layer.

The formation of the barrier layer constituted of such a metallic oxide is performed by the vacuum deposition method, CVD method (chemical vapor deposition), the glow discharge decomposition method, the ion implantation method, the ion-plating method, and the electron beam method.

For example, according to the sputtering method, the formation of the barrier layer can be accomplished by using a wafer of starting material for formation of a barrier layer as a target, and sputtering the target in an atmosphere of sputtering purpose gas such as He, Ne, Ar, and the like.

When the electron beam method is applied, a starting material for formation of a barrier layer may be placed in an evaporator boat and irradiated with electron beam.

The thickness of the barrier layer is usually 30–1000 Å, preferably 50–600 Å.

EXAMPLE 1

A mirror-finished substrate, 1 mm thick and 10 cm×10 cm size, made of aluminum alloy 52S (containing Si, Mg, and Cr) was subjected to alkali washing, acid washing and then rinsed with pure water.

On the other side, a resin A represented by formula (1) wherein the whole $R_1$ and $R_2$ in the molecule was a combination of methyl and phenyl at a molar ratio of methyl:phenyl=2:1 and a resin P represented by formula (2) were dissolved in a weight ratio of resin A:resin P=3:2 in n-butyl Cellosolve acetate to prepare a resin solution, $L_A$, of concentration 20 wt.%.

This resin solution $L_A$ was sprayed on the above substrate, and the coating was cured in an atmosphere of $N_2$ gas of 450° C. for 1 hour to form a resin layer 1μ thick.

Figure 2:
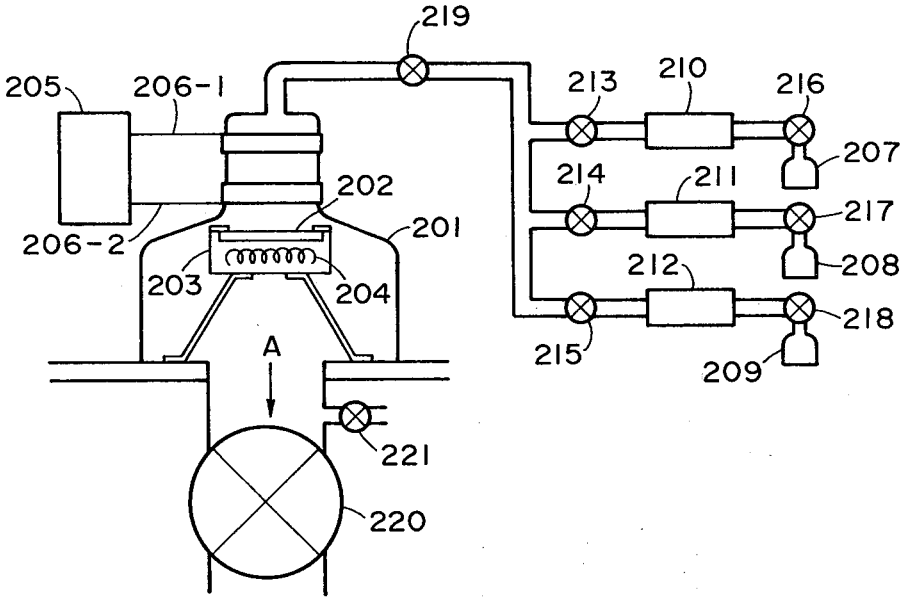
FIG. 2 is an illustration of an apparatus for preparing the electrophotographic image-forming member of this invention.

Subsequently, using the apparatus shown in FIG. 2, an electrophotographic image-forming member of this invention was prepared in the following way, and then processed to form an image.

The substrate coated with the resin layer 102 treated as mentioned above was securely fastened about 5 cm apart from a heater 204 to a definite position on a fixing member 203 set up in a definite position in a deposition chamber 201.

Then, the deposition chamber 201 was evacuated to about $5\times10^{-5}$ Torr by fully opening a main valve 220. The heater 204 was switched on to heat said substrate uniformly to 100° C., and this temperature was maintained. Then, an auxiliary valve 219 and successively the needle valve 213 of a bomb 207 and the needle valve 214 of a bomb 208 were fully opened, and thereafter flow control valves 216 and 217 were gradually opened to introduce $H_2$ gas from the bomb 207 through a mass-flow controller 210 and $SiH_4$ gas from the bomb 208 through a mass-flow controller 211 into the deposition chamber 201, respectively. The $H_2$ gas:$SiH_4$ gas flow ratio was maintained at 2:10 by regulating the valves 216 and 217. Further, the main valve 220 was regulated to keep the pressure in the deposition chamber at about 0.75 Torr. Then, the switch of a high-frequency power source 205 was turned on to apply a high-frequency field of 13.56 MHz between electrodes 206-1 and 206-2, thereby generating a glow discharge and forming a photoconductive layer on the substrate. The power of the glow discharge was 5 W. The rate of growth of the layer was about 4 Å/sec, and the photoconductive layer grew to a thickness of 20μ after 15 hours' deposition. Thereafter, the main valve 220, the flow control valves 216 and 217, and the needle valves 213 and 214 were closed, and a valve 221 was opened to break the vacuum in the deposition chamber 201, and the electrophotographic image-forming member thus prepared was taken out.

The image-forming member was negatively charged by exposing its surface to a corona discharge in a dark place at a supply voltage of 5500 V for 0.5 second, and successively was subjected to image exposure of a light quantity of 10 lux·sec. by use of a halogen lamp to form an electrostatic image, which was developed by the magnetic brush development method utilizing a development bias. On transferring and fixing the developed image onto transfer paper, a sharp and clear image of high resolution was obtained.

Results of measuring the surface potential of this image-forming member showed that the surface potential of the region corresponding to the black portion of the image (hereinafter, referred to as dark portion potential) was about 240 V and the surface potential of the region corresponding to the white portion of the image (hereinafter, referred to as light portion potential) was about 50 V.

The image-forming member was tested for its durability by repeating the above-said imaging treatments. As a result, the image obtained on the 10,000-th transfer paper had also very high quality and showed no difference from the image obtained on the first transfer paper. This verified that this electrophotographic image-forming member is excellent in resistance to corona ions, wear resistance, cleaning resistance, and durability. For testing the cleaning resistance, the blade cleaning method was applied, wherein a urethane rubber molding product was used as the blade.

Referring to the surface potential of this image-forming member in said repeated imaging operations, both the dark portion potential and light portion potential were invariably constant, the former being about 240 V and the latter being about 50 V, and none of undesirable changes occurred such as decrease in dark portion potential and increase in residual potential.

EXAMPLE 2

A mirror-finished substrate, 1 mm thick and 10 cm×10 cm size, made of aluminum alloy 61S (containing Cu, Si, and Cr) was coated by dip coating with a resin solution, $L_B$, which had been prepared by dissolving a resin B represented by formula (1) wherein $R_1$ and $R_2$ each are methyl and a resin P in a weight ratio of resin B:resin P=3:2 in n-butyl Cellosolve acetate to give a concentration of 30 wt.%. The coating was cured in an atmosphere of $N_2$ gas at 450° C. for 1.5 hours to form a resin layer 102 of 1.5μ thick. Using this substrate overlaid with the resin layer 102, an image-forming member was prepared and tested for image quality and durability in the same manner as Example 1 to obtain good results in respect to all these properties.

EXAMPLE 3

Image-forming members were prepared and tested for image quality and repeatability to repeated operations, in the same manner as Example 1, except that thickness of the resin layer formed on the substrate by use of the resin solution $L_A$ was varied. In magnetic brush development, development bias values were chosen so as to give the best image to each image-forming member. The results are shown in Table 1.

TABLE 1

| Thickness of resin layer (μ) | Quality of transfer image in this first operation | Repeatability | Summarized evaluation of transfer image |
|---|---|---|---|
| 0.03 | × (Image density was low) | | × |
| 0.1 | Δ (Image density somewhat low | (Fogging of background appeared in the negligible extent.) | |
| 0.5 | (Image density was high) | (Fogging of background appeared in the negligible extent.) | |
| 2 | (Image density was high) | (Fogging of background appeared in the negligible extent.) | |
| 5 | (Image density was high) | Δ (Fogging of background gradually appeared.) | |
| 20 | (Image density was high) | × (Fogging of background readily appeared.) | × |

Marks in Summarized evaluation of transfer image:
: Excellent,
: Good,
×: Somewhat inferior for practical use

EXAMPLE 4

An electrophotographic image-forming member was prepared in the following way by use of the apparatus shown in FIG. 2, from the substrate on which the resin layer 102 had been formed in the same manner as Example 1.

The substrate 202 was securely fastened about 5 cm apart from a heater 204 to a definite position on a fixing member 203 set up in a definite position in a deposition chamber 201.

Then, the deposition chamber 201 was evacuated to about $5\times10^{-5}$ Torr by fully opening a main valve 220. The heater 204 was switched on to heat said substrate uniformly to 100° C., and this temperature was maintained. Then, an auxiliary valve 219 and successively the respective needle valves 213, 214, and 215 of bombs 207, 208, and 209 were fully opened, and thereafter flow control valves 216, 217, and 218 were gradually opened to introduce $H_2$ gas, $SiH_4$ gas, and $GeH_4$ gas from the bombs 207, 208, and 209 through mass-flow controllers 210, 211, and 212, respectively, into the deposition chamber 201. The flow ratio of $H_2$ gas:$SiH_4$ gas:$GeH_4$ gas was maintained at 2:0.75:0.25 by regulating the valves 216, 217, and 218. Further, the main valve 220 was regulated to keep the pressure in the deposition chamber at about 0.8 Torr.

Then, the switch of a high-frequency power source 205 was turned on to apply a high-frequency field of 13.56 MHz between electrodes 206-1 and 206-2, followed by generating a glow discharge and forming a photoconductive layer on the substrate. The power of the glow discharge was 3 W.

A a-SiGe(H) film of about 20μ in thickness was formed by continuing deposition for 17 hours under such conditions.

The image-forming member thus prepared was tested in the same way as Example 1, with the result that it was excellent in both image characteristics and repeatability.

What is claimed is:

1. An electrophotographic image-forming member which comprises:

an electrophotographic supporting substrate;

a photoconductive layer comprising an amorphous material which contains silicon atoms as matrix and at least one of hydrogen atoms and halogen atoms; and a resin layer formed by use of a ladder type of silicon resin, between said supporting substrate and photoconductive layer.

2. An electrophotographic image-forming member of claim 1, wherein said amorphous material contains also germanium as constituent atoms.

3. An electrophotographic image-forming member of claim 1, which further has a barrier layer between the resin layer and the photoconductive layer.

4. An electrophotographic image-forming member of claim 3, wherein said barrier layer has a thickness of 30 to 1000 angstroms.

5. An electrophotographic image-forming member of claim 1, which further has a barrier layer between the substrate and the resin layer.

6. An electrophotographic image-forming member of claim 5, wherein the thickness of said barrier layer ranges from 30 to 1000 angstroms.

7. An electrophotographic image-forming member of claim 1, wherein the thickness of said resin layer ranges from 0.1 to 5 microns.

8. An electrophotographic image-forming member of claim 1, wherein said ladder-type silicon resins have the following formula:

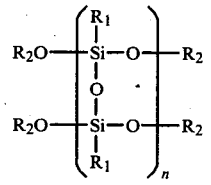

wherein $R_1$ and $R_2$ each represent a substituent selected from hydrogen, methyl, ethyl and phenyl.

9. An electrophotographic image-forming member of claim 1, wherein said substrate is in the shape of a cylinder.

10. An electrophotographic image-forming member of claim 1, wherein the thickness of said photoconductive layer ranges from 3 to 100 microns.

11. An electrophotographic image-forming member of claim 1, wherein said photoconductive layer contains an impurity.

12. An electrophotographic image-forming member of claim 11, wherein said impurity is an element in Group VA of the periodic table.

13. An electrophotographic image-forming member of claim 12, wherein said element in Group VA of the periodic table is selected from N, P, As, Sb, and Bi.

14. An electrophotographic image-forming member of claim 11, wherein said impurity is an element in Group IIIA of the periodic table.

15. An electrophotographic image-forming member of claim 14, wherein said element in Group IIIA of the periodic table is selected from B, Al, Ga, In, and Tl.

16. An electrophotographic image-forming member of claim 3, wherein said barrier layer comprises an amorphous material containing at least one selected from the group consisting of a carbon atom, a nitrogen atom and an oxygen atom in a silicon matrix.

17. An electrophotographic image-forming member of claim 16, wherein said amorphous material further contains at least one selected from the group consisting of a hydrogen atom and a halogen atom.

18. An electrophotographic image-forming member of claim 5, wherein said barrier layer comprises an amorphous material containing at least one selected from the group consisting of a carbon atom, a nitrogen atom, and an oxygen atom in a silicon matrix.

19. An electrophotographic image-forming member of claim 18, wherein said amorphous material further contains at least one selected from the group consisting of a hydrogen atom and a halogen atom.

20. An electrophotographic image-forming member of claim 3, wherein said barrier layer contains an electrically insulating metallic oxide.

21. An electrophotographic image-forming member of claim 20, wherein said electrically insulating metallic oxide is at least one selected from the group consisting of $TiO_2$, $Ce_2O_3$, $ZrO_2$, $HfO_2$, $GeO_2$, CaO, BeO, $P_2O_5$, $Y_2O_3$, $Cr_2O_3$, $Al_2O_3$, MgO, $Mg.Al_2O_3$ and $SiO_2.MgO$.

22. An electrophotographic image-forming member of claim 5, wherein said barrier layer contains an electrically insulating metallic oxide.

23. An electrophotographic image-forming member of claim 22, wherein said electrically insulating metallic oxide is at least one selected from the group consisting of $TiO_2$, $Ce_2O_3$, $ZrO_2$, $HfO_2$, $GeO_2$, CaO, BeO, $P_2O_5$, $Y_2O_3$, $Cr_2O_3$, $Al_2O_3$, MgO, $MgO.Al_2O_2$ and SiO.MgO.

24. An electrophotographic image-forming member of claim 1, wherein the content of hydrogen (H) in said photoconductive layer ranges from one to 40 atomic percent.

25. An electrophotographic image-forming member of claim 1, wherein the content of halogen (X) in said photoconductive layer ranges from one to 40 atomic percent.

26. An electrophotographic image-forming member of claim 1, wherein the total content of hydrogen (H) and halogen (X) ranges from one to 40 atomic percent.

* * * * *

UNITED STATES PATENT AND TRADEMARK OFFICE

CERTIFICATE OF CORRECTION

PATENT NO. : 4,405,702

DATED : September 20, 1983

INVENTOR(S) : SHIGERU SHIRAI, ET AL.

It is certified that error appears in the above-identified patent and that said Letters Patent is hereby corrected as shown below:

Col. 4, line 16, delete "very"
Col. 5, line 67, after "also" insert --be--.
Col. 7, line 35, "dopted" should be --doped--.
Col. 10, line 8, after "kinds" insert --of--.

UNITED STATES PATENT AND TRADEMARK OFFICE

CERTIFICATE OF CORRECTION

PATENT NO. : 4,405,702 Page 2 of 2

DATED : September 20, 1983

INVENTOR(S) : SHIGERU SHIRAI, ET AL.

It is certified that error appears in the above-identified patent and that said Letters Patent is hereby corrected as shown below:

Col. 13, lines 27-48,

" TABLE 1 "

| Thickness of resin layer (μ) | Quality of transfer image in this first operation | Repeatability | Summarized evaluation of transfer image |
|---|---|---|---|
| 0.03 | X (Image density was low) | | X |
| 0.1 | Δ (Image density somewhat low | (Fogging of background appeared in the negligible extent.) | |
| 0.5 | (Image density was high) | (Fogging of background appeared in the negligible extent.) | |
| 2 | (Image density was high) | (Fogging of background appeared in the negligible extent.) | |
| 5 | (Image density was high) | Δ (Fogging of background gradually appeared.) | |
| 20 | (Image density was high) | × (Fogging of background readily appeared.) | × |

Marks in Summarized evaluation of transfer image:
: Excellent.
: Good.
×: Somewhat inferior for practical use to

-- TABLE 1 --

| Thickness of resin layer (μ) | Quality of transfer image in this first operation | Repeatability | Summarized evaluation of transfer image |
|---|---|---|---|
| 0.03 | × (Image density was low) | | × |
| 0.1 | Δ (Image density somewhat low | ○ (Fogging of background appeared in the negligible extent.) | ○ |
| 0.5 | ○ (Image density was high) | ○ (Fogging of background appeared in the negligible extent.) | ◎ |
| 2 | ○ (Image density was high) | ○ (Fogging of background appeared in the negligible extent.) | ◎ |
| 5 | ○ (Image density was high) | Δ (Fogging of background gradually appeared.) | ○ |
| 20 | ○ (Image density was high) | × (Fogging of background readily appeared.) | × |

Marks in Summarized evaluation of transfer image:
◎ : Excellent.
○ : Good.
× : Somewhat inferior for practical use Signed and Sealed this Thirteenth Day of December 1983

[SEAL]

*Attest:*

GERALD J. MOSSINGHOFF

*Attesting Officer*

*Commissioner of Patents and Trademarks*